United States Patent [19]

Daenen

[11] 4,412,630

[45] Nov. 1, 1983

[54] CONTAINER CLOSURE ALIGNMENT DEVICE

[75] Inventor: Robert H. C. M. Daenen, Hekelgem, Belgium

[73] Assignee: Dart Industries Inc., Northbrook, Ill.

[21] Appl. No.: 356,601

[22] Filed: Mar. 9, 1982

[51] Int. Cl.[3] ..... B65D 43/04; B65D 43/08

[52] U.S. Cl. ..... 220/353; 220/355; 150/55

[58] Field of Search ..... 220/353, 355, 306, 307; 150/0.5

[56] References Cited

U.S. PATENT DOCUMENTS

| | | | |
|---|---|---|---|
| 2,454,455 | 12/1945 | Irwin | 206/41 |
| 3,487,972 | 1/1970 | Swett | 220/355 |
| 3,825,049 | 7/1974 | Swett et al. | 150/0.5 |
| 3,834,437 | 9/1974 | Swett et al. | 150/0.5 |
| 3,915,532 | 10/1975 | Ashton | 150/0.5 |
| 3,966,082 | 6/1976 | Hopkins | 220/306 |
| 4,068,775 | 1/1978 | Palmer | 215/331 |
| 4,091,953 | 5/1978 | Daenen | 220/355 |
| 4,252,248 | 2/1981 | Obrist | 220/270 |
| 4,293,079 | 10/1981 | Lytle | 220/306 |

FOREIGN PATENT DOCUMENTS 388181 3/1963 Switzerland .

*Primary Examiner*—George T. Hall
*Attorney, Agent, or Firm*—John A. Doninger

[57] ABSTRACT

A device for properly aligning the sealing member of a cover relative to the sealing rim of a container. The device includes at least one alignment tab which cooperates with at least one alignment slot to align the sealing member of a cover with respect to the sealing rim of a container. Accurate alignment of the sealing member and sealing rim ensures a proper seal and prevents deformation of the container and cover due to misalignment.

8 Claims, 12 Drawing Figures

CONTAINER CLOSURE ALIGNMENT DEVICE

The present invention pertains to a container closure. More particularly, the invention relates to a means for properly aligning the cover with respect to the container so that a proper seal is effected and the container is not deformed when the cover is in the installed position.

Containers and covers which hermetically seal such containers have been in use for some time. Containers and covers made of polypropylene, polyethylene or other locally deformable yet resilient compositions have proven to be excellent for use in such containers.

Typically, the covers of such containers are installed by placing the cover over the container, pressing firmly, and working the edges of the cover over the rim of the container into the sealed position. When initially pressing the cover into position, the cover may tend to shift slightly one way or the other. When the shape of the container rim is round, this does not present a problem because the position of the cover relative to the container is not critical. However, with container rims of other shapes, such as square or rectangular, misalignment of the cover relative to the container can present a problem. For example, a misaligned cover can cause the container to warp when the cover is on or make it impossible to completely install the cover. A misaligned cover can also affect the hermetic seal between the cover and the container.

The present invention provides for an alignment means between the cover and the container so that when pressed into position the cover is properly aligned. More specifically, a tab and slot arrangement is provided on the cover and container so that proper alignment of the cover is assured.

Thus it is an object of this invention to improve hermetically sealable containers and covers.

It is a further object of this invention to provide an arrangement to assure proper alignment of the cover of a container as it is pressed into a sealed position.

It is yet another object of this invention to provide a tab and slot arrangement for properly positioning a cover with respect to a container prior to pressing it into a sealing position.

These and other objects and advantages of the invention will become more apparent from the following detailed description of a preferred embodiment of the invention when taken into conjunction with the drawings wherein.

Figure 1:
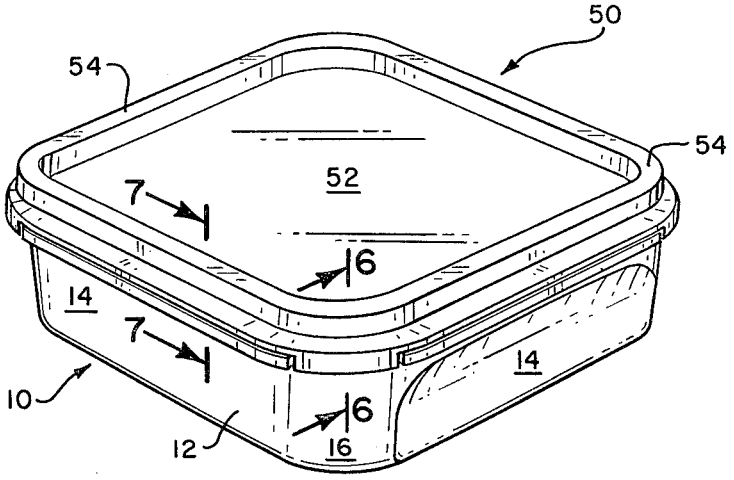
FIG. 1 is a top perspective view of a container with a cover in the installed position.
Figure 2:
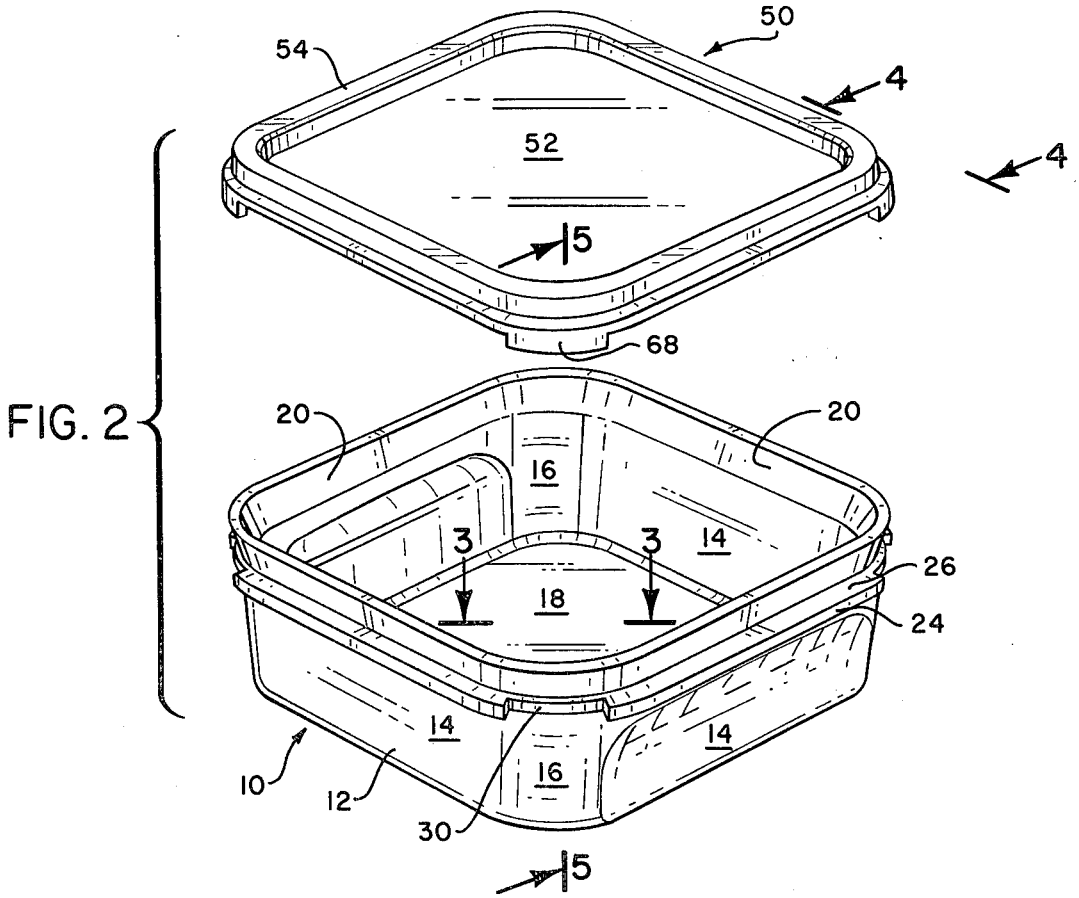
FIG. 2 is an exploded perspective view of the container and cover shown in FIG. 1.
Figure 3:
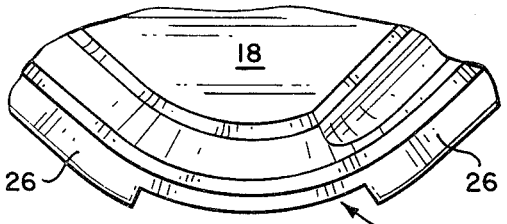
FIG. 3 is a top plan view of one corner of the container taken generally along line 3—3 of FIG. 2.
Figure 4:
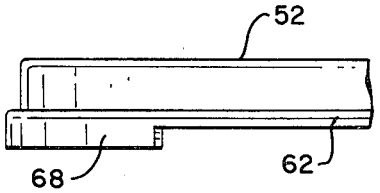
FIG. 4 is a side elevation view of one corner of the cover taken along line 4—4 of FIG. 2.

Referring to the figures, in particular FIGS. 1, 2, 9 and 10, there is shown a container 10 and a cover 50. The container 10 includes a wall structure generally identified by numeral 12. The wall structure 12 includes oppositely facing sidewalls 14 and curved walls 16. A bottom wall 18 is positioned at the lower end of the wall structure 12.

Figure 5:
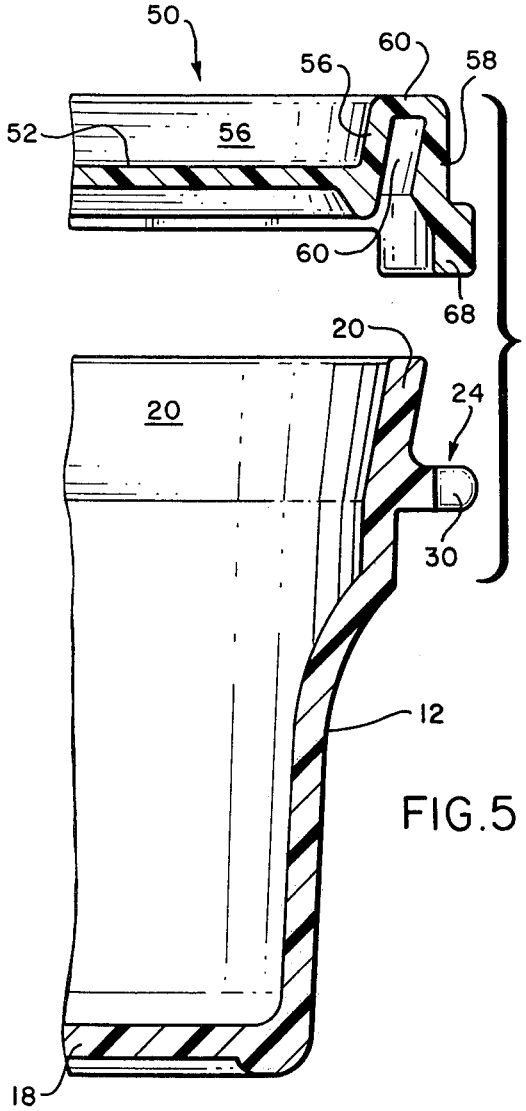
FIG. 5 is a cross-sectional view of one corner of the container and cover taken along line 5—5 of FIG. 2.
Figure 6:
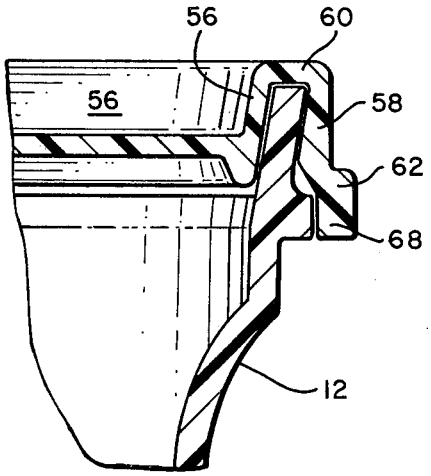
FIG. 6 is a cross-sectional view of one corner of the container with the cover in the installed position taken along line 6—6 of FIG. 1.
Figure 7:
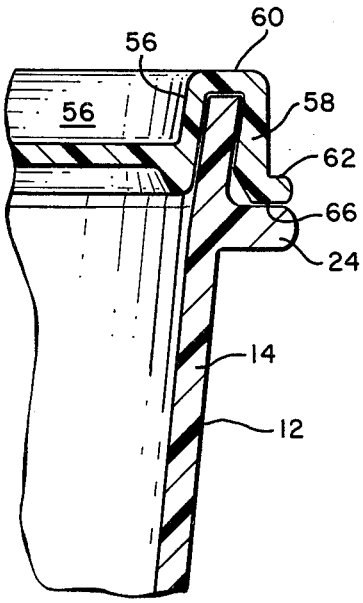
FIG. 7 is a cross-sectional view of one side wall of the container with the cover in the installed position taken along line 7—7 of FIG. 1.

A sealing rim 20 is positioned at the open end 22 of the container. As can best be seen in FIGS. 5, 6 and 7, the sealing rim 20 is flared slightly outwardly relative to the side walls 14 and the curved walls 16. An outwardly extending flange 24 is positioned on the wall structure 12. The flange 24 has an upper surface 26, a lower surface 28 and at least one alignment slot 30. In the embodiments shown in FIGS. 2 and 10, alignment slots are positioned proximate each curved wall 16. It should be noted that the sealing rim 20 and the flange are thicker than the wall structure 12 to impart greater rigidity at the open end 22 of the container.

The cover 50 includes a substantially planar central portion 52 and a sealing member 54 extending about the periphery of the central portion 52. The sealing member 54 includes a first or inner section 56, a second or outer section 58, connected at one end by a third or top section 60 to form a generally U-shaped groove 60. A lip 62 having an upper surface 64 and a lower surface 66 is positioned at the free end of the outer section 58. The lip 62 has a downwardly extending alignment tab 68 adapted to mate with the alignment slot 30. As can best be seen in FIG. 7 the outer surface 64 fits snugly against the upper flange surface 26 when the cover 50 is in the installed position. As can best be seen in FIGS. 1, 6 and 9, the alignment tab 66 fits snugly into flange slot 30.

Figure 8:
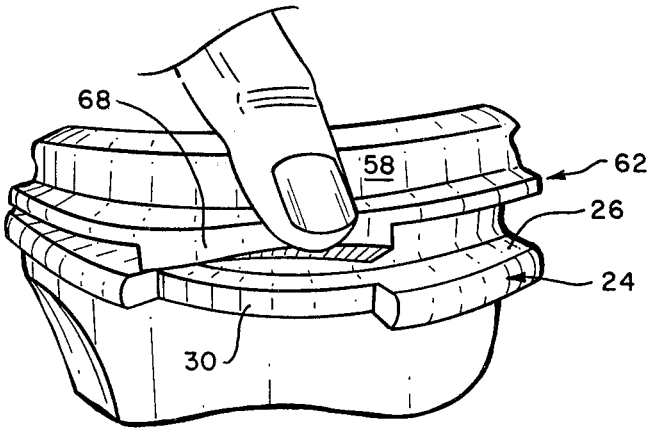
FIG. 8 is a partial perspective view showing one corner of the cover being positioned on the rim of the container.

The cover 50 is placed on the container 10 in the following manner. The alignment tab 68 is positioned in slot 30. In this regard it should be noted that the cover 50, in particular sealing member 54 and alignment tab 68, may be flexible to facilitate placement in slot 30. This is illustrated in FIG. 8. Thus, with the cover initially properly aligned, the sealing member is pressed into position on the rim 20.

Figure 9:
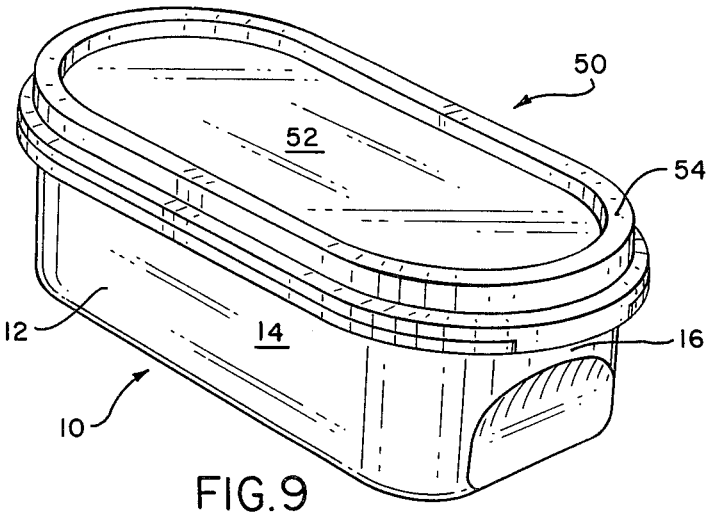
FIG. 9 is a top perspective view of another container with a cover in the installed position.
Figure 10:
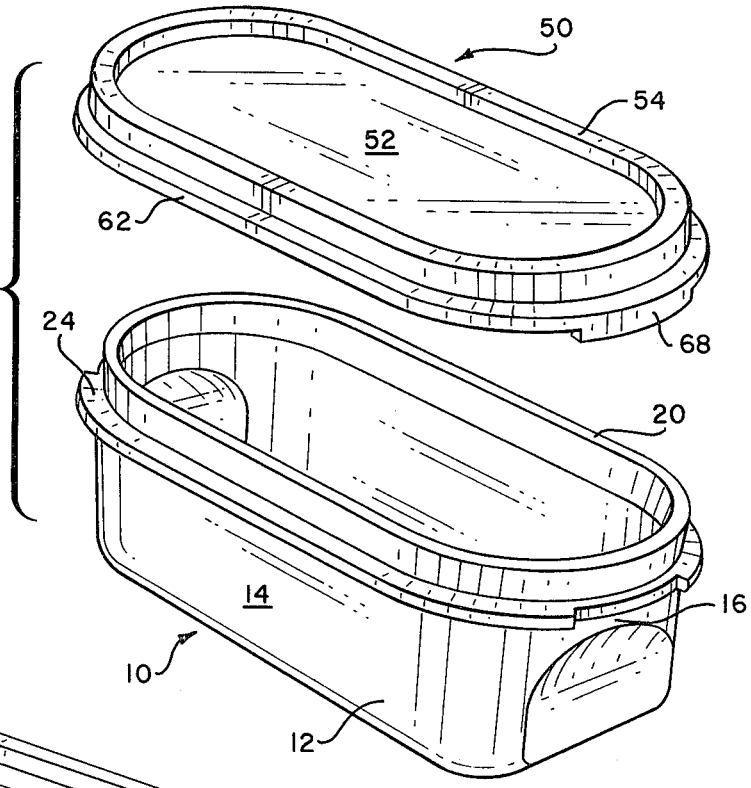
FIG. 10 is an exploded perspective view of the container shown in FIG. 9.
Figure 11:
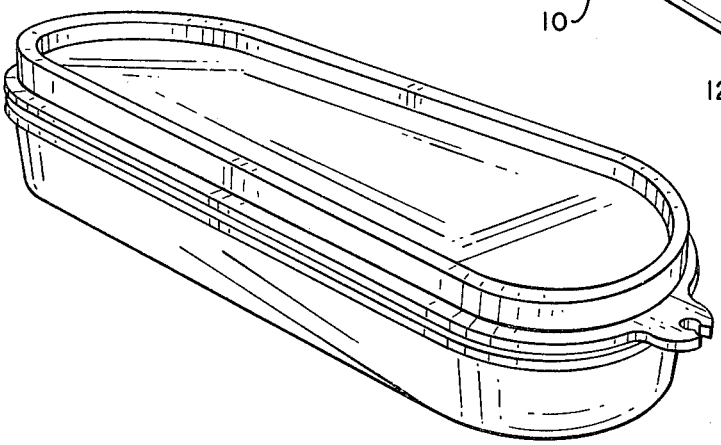
FIG. 11 is a top perspective view of a prior art container with the top misaligned such that the container is warped.
Figure 12:
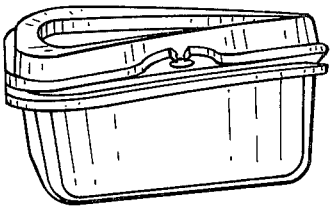
FIG. 12 is an end view of the container as show in FIG. 11.

In the preferred embodiment, alignment slots are positioned in the flange 24 proximate each curved wall 16. This further facilitates proper alignment of the cover 10 since an alignment tab 68 is positioned in a slot 30 periodically as the cover 10 is installed. The plurality of alignment tabs 68 and alignment slots 30 facilitates installation since one can start at any curved wall 16. This also minimizes repositioning of the cover relative to the container as would have to be done if a single tab would have to be aligned with a single slot. It can be seen that the tab 68 and slot 30 provide an alignment means which cooperate to align the cover sealing member 54 with respect to the container sealing rim 20 such that the cover can be properly fitted onto the container as shown in FIGS. 1 and 9. It certainly would also be possible to reverse the tab and slot arrangement such that the tab or its equivalent would be positioned on the flange and the slot or its equivalent would be positioned on the sealing member. Thus, misalignment of the cover which can cause warping of the container and can affect the hermetic seal between the cover and the container is prevented. FIGS. 11 and 12 are illustrative of a prior art container on which the cover is misaligned. It should be understood that while a preferred embodiment of the invention has been disclosed, modifications and alterations may be made by those skilled in the art which would fall within the limits of this invention and within the scope of the claims appended hereto.

I claim:

1. A container having a wall structure and a bottom wall at one end of said wall structure;

said wall structure including at least two sidewalls joined by at least two curved walls;

said wall structure further including a sealing rim positioned at the end of the container opposite the bottom wall;

a cover having a central portion and a sealing member positioned about said central portion and adapted to mate with said sealing rim;

alignment means on said cover and said side wall structure cooperating to align the sealing member with respect to the sealing rim such that the cover can be properly fitted onto the container.

2. The container of claim 1 wherein said sidewall structure includes at least one outwardly extending flange, and said alignment means is positioned in said outwardly extending flange and said sealing member.

3. The container of claim 2 wherein said alignment means comprises at least one slot and at least one tab, one of which is positioned on said sealing member and the other of which is positioned in said flange.

4. The container of claim 2 wherein said at least one slot is positioned in said flange and said at least one tab is positioned on said cover sealing member, said tab being adapted to fit into said slot thereby positioning the sealing member with respect to said sealing rim.

5. The container of claim 4 wherein said slot is positioned proximate one of said curved walls.

6. The container of claim 2 wherein said alignment means comprises at least one pair of slots in said flange and at least one pair of tabs on said cover sealing member, said one pair of slots being positioned opposite each other, said tabs being adapted to fit into said slots thereby positioning the sealing member with respect to the sealing rim such that the cover can be properly fitted onto the container.

7. The container of claim 6 wherein one of said pair of slots is positioned proximate one of said curved walls and the other one of said pair of slots is positioned proximate the other of said curved walls.

8. The container of claim 2 wherein said alignment means comprises a plurality of slots in said flange and a plurality of tabs on said cover sealing member, one of said slots being positioned proximate each of said curved walls said tabs being adapted to fit into said slots thereby positioning the sealing member with respect to the sealing rim such that the cover can be properly fitted onto the container.

* * * * *